United States Patent [19]

Todman

[11] Patent Number: 4,861,228

[45] Date of Patent: Aug. 29, 1989

[54] VARIABLE STATOR VANE ASSEMBLY

[75] Inventor: Michael T. Todman, Warwick, England

[73] Assignee: Rolls-Royce PLC, London, England

[21] Appl. No.: 232,858

[22] Filed: Aug. 16, 1988

[30] Foreign Application Priority Data

Oct. 10, 1987 [GB] United Kingdom ..... 8723875

[51] Int. Cl.[4] ..... F01D 5/18

[52] U.S. Cl. ..... 415/115; 415/116; 415/150; 415/160

[58] Field of Search ..... 415/115, 116, 150, 160, 415/175, 180, 117

[56] References Cited

U.S. PATENT DOCUMENTS

| | | | |
|---|---|---|---|
| 3,284,048 | 11/1966 | Tumavicus | 415/160 |
| 3,367,628 | 2/1968 | Fitton | 415/115 |
| 3,542,484 | 11/1970 | Mason | 415/160 |
| 3,652,177 | 3/1972 | Loebel | 415/160 |
| 3,695,777 | 10/1972 | Westphal et al. | 415/160 |
| 4,214,851 | 7/1980 | Tuley et al. | 415/115 |

FOREIGN PATENT DOCUMENTS

| | | | |
|---|---|---|---|
| 88257 | 1/1937 | Sweden | 415/160 |
| 805015 | 6/1956 | United Kingdom . | |
| 1072538 | 12/1965 | United Kingdom . | |
| 1200348 | 10/1967 | United Kingdom . | |
| 1201949 | 10/1967 | United Kingdom . | |
| 1263857 | 5/1970 | United Kingdom . | |
| 1286785 | 4/1971 | United Kingdom . | |
| 2016091 | 3/1979 | United Kingdom . | |

*Primary Examiner*—Robert E. Garrett
*Assistant Examiner*—John T. Kwon
*Attorney, Agent, or Firm*—Cushman, Darby & Cushman

[57] ABSTRACT

A variable stator vane assembly suitable for a power turbine in which each stator vane is provided at its radially inner and outer extents with disc-shaped platforms which locate on bushes provided on associated support structure. The bushes are cooled by a flow of cooling air which is of higher pressure than that of the hot gases operationally flowing over the vanes so as to prevent the leakage of such hot gases past the bushes.

8 Claims, 2 Drawing Sheets

VARIABLE STATOR VANE ASSEMBLY

This invention relates to a variable stator vane assembly and in particular to a variable stator vane assembly suitable for a power turbine, which power turbine is adapted to be driven by the exhaust efflux of a gas turbine engine.

One common form of power generation equipment for both land-based and marine use comprises a gas turbine engine, the exhaust efflux of which is utilized to drive a power turbine. The output of the power turbine is then used to drive an electrical generator or alternatively to provide a direct drive, usually through a suitable gearbox, to a power output shaft.

In the quest for improved performance, power turbines are being called upon to be more efficient. One way of improving efficiency is to increase the temperature of the gas turbine exhaust efflux entering the power turbine to a figure in excess of 750° C. Further improvements in efficiency can be achieved by arranging that the first array of stator aerofoil vanes in the power turbine are variable. Thus the vanes are arranged to pivot about their longitudinal axes so that they can be controlled by a suitable mechanism to ensure that they are always at the optimum angle of attack to the gas turbine engine efflux entering the power turbine.

One problem with the use of variable stator vanes in a high temperature environment is that suitable means must be provided to support the vanes which are both resistant to the high temperatures of the environment and which do not provide a route for the leakage of gas turbine engine efflux from the main gas passage through the power turbine.

It is an object of the present invention to provide a stator vane assembly having such suitable support means.

According to the present invention, a variable stator aerofoil vane assembly comprises an annular array of generally radially extending aerofoil cross-section stator vanes, and support structure the radially inner and outer extents of said vanes so that said vanes are pivotable about their longitudinal axes, each of said vanes being provided at each of its longitudinal extents with means to cooperate with said support structure to limit any radial movement of said vane, and bush means interposed between each of said platforms and said support structure, means being provided to supply a cooling fluid to said bush means at a pressure higher than that of any fluid operationally flowing over said vanes, said stator vane assembly being so arranged that any such cooling fluid is placed in heat exchange relationship with said bush means and is subsequently exhausted into said fluid operationally flowing over said vanes.

The present invention will now be described, by way of example, with reference to the accompanying drawings in which.

Figure 1:
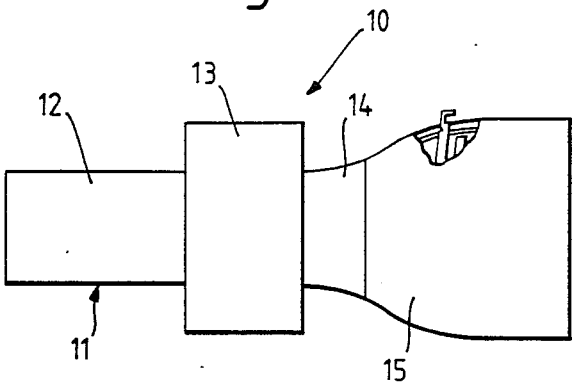
FIG. 1 is a partially broken away side view of a gas turbine engine and its associated power turbine, the broken away portion showing a part of a variable stator aerofoil vane assembly of the power turbine in accordance with the present invention.

With reference to FIG. 1, a gas turbine engine/power combination generally indicated at 10 comprises a gas turbine engine 11 having in flow series, compressor 12 combustion 13 and turbine sections 14, and a power turbine 15 which is mounted at the downstream end of the gas turbine engine 11. The power turbine 15 is adapted to receive, and is driven by, the exhaust efflux from the gas turbine engine 11. The power turbine 15 in turn provides a power output via a suitable output shaft (not shown) to, for instance, an electrical generator or gearbox. In general both the power turbine 15 and the gas turbine engine 11 are of conventional construction and will not, therefore, be described in detail.

Figure 2:
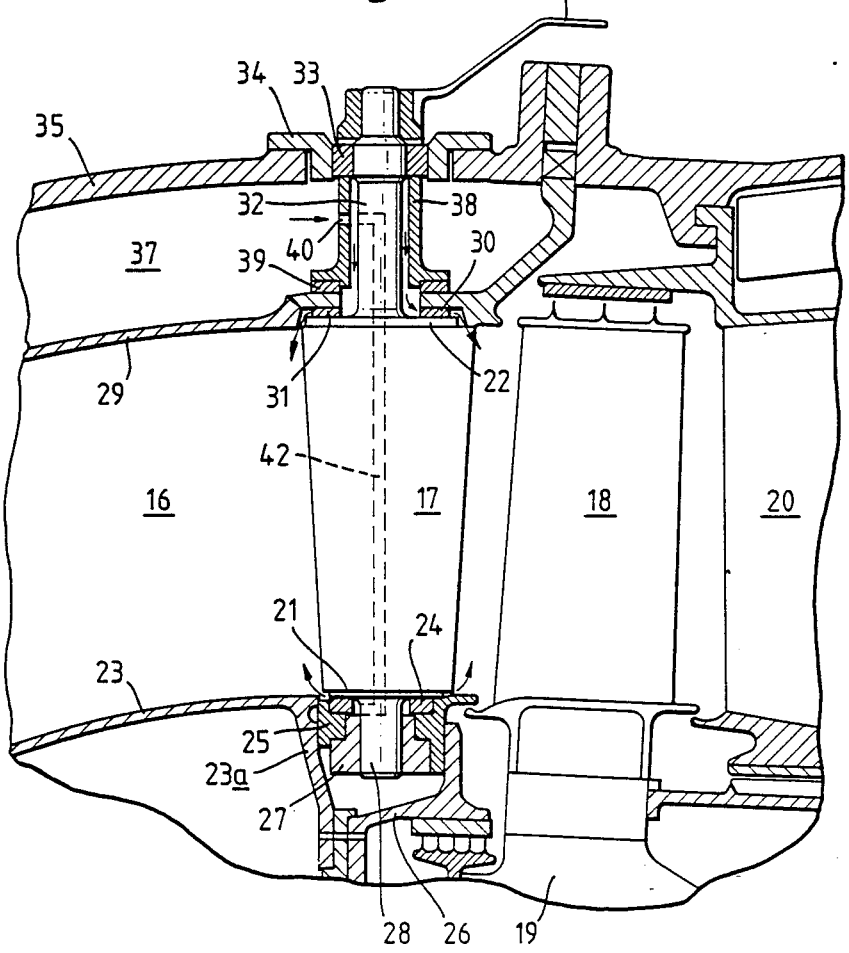
FIG. 2 is an enlarged sectioned view of the variable stator aerofoil vane assembly part shown in FIG. 1.

The exhaust efflux from the gas turbine engine 11 is directed into the power turbine 15 via an annular interconnecting duct 16, a portion of the downstream end of which can be seen if reference is now made to FIG. 2. The interconnecting duct 16 directs the exhaust efflux on to an assembly which includes an annular array of radially extending variable stator aerofoil vanes 17, a portion of which assembly can be seen in FIG. 2. The stator vanes 17 serve to direct the exhaust efflux on to an annular array of rotor aerofoil blades 18, one of which can be seen in FIG. 2, mounted on a disc 19 which is in turn mounted on the power output shaft (not shown) of the power turbine 15. The efflux gases then flow on to a second annular array of fixed non-variable stator vanes 20, a portion of one of which can be seen in FIG. 2 and subsequently pass through the remaining stages of the power turbine 15 in the conventional manner.

As stated earlier, the stator aerofoil vanes 17 are variable, that is, pivotable about their longitudinal axes so that the direction in which the gas turbine engine exhaust efflux is directed thereby on to the rotor aerofoil blades 18 is the optimum for a given set of operating conditions. This ensures that the power turbine 15 operates in an efficient manner but the high temperatures (in excess of 750° C.) of the efflux gases directed on to the stator vanes 17 means that the operating mechanism for the variable stator vanes 17, is vulnerable to heat damage and potentially provides a leakage path for the efflux gases.

Each stator vane 17 is provided at its radially inner and outer longitudinal extents with generally disc shaped platforms 21 and 22 respectively. Each radially inner platform 21 is contiguous with the radially inner wall 23 of the interconnecting duct 16 and locates on an annular bush 24 which itself locates in a corresponding recess provided in an annular support member 25. The annular support member 25 is, in turn, held at the downstream end of the interconnecting duct 16 sandwiched between a flanged ring 26 which is attached to an inwardly directed flange **23*a* provided on the downstream end of the inner wall 23 of the duct 16, and the flange 23*a*** itself.

The annular support member 25 additionally carries a series of second, larger bushes 27, each of which receives a spigot 28 which extends from and is generally normal to each radially inner platform 21.

Each radially outer platform 22 locates in a corresponding recess 30 provided in the radially outer wall 29 of the interconnecting duct 16 so as to be contiguous with that wall 29. Each recess 30 additionally contains an annular bush 31 on which its corresponding radially outer platform 22 locates.

Each of the radially outer platforms 22 has a spigot 32 extending generally normally thereto. Each of the radially outer spigots 32 is coaxial with but longer than its corresponding radially inner spigot 28. This is to ensure that each radially outer spigot 32 extends beyond the interconnecting duct 16 to locate in a further bush 33 carrier by a support ring 34 located in the outer casing 35 of the power turbine 15.

It will be seen therefore that each stator vane 17 is located radially by its associated inner and outer bushes 24 and 31 respectively and is permitted, by virtue of the location of its associated inner and outer spigots 26 and 32 in the inner and outer bushes 27 and 33 respectively, to pivot about its longitudinal axis.

The radially outer extent of each of the radially outer spigots 32 has a cranked arm 36 attached thereto. Each of the cranked arms 36 is linked to an actuation ring (not shown) to bring about variation in the pivotal positions of the stator vanes 17 in the conventional manner.

The outer casing 35 of the power turbine 15 is radially spaced apart from the radially outer wall 29 of the interconnecting duct 16 so that they cooperate to define an annular passage 37. The annular passage 37 across which, of course, the radially outer spigots 32 extend, is supplied with cooling air tapped from the gas turbine engine 11. The cooling air is arranged to be at a higher pressure than that of the gas turbine engine 11 exhaust efflux which operationally flows through the interconnecting duct 16.

In order to ensure that the cooling air within the passage 37 provides effective cooling of the radially outer spigots 32, each of those spigots 32 is coaxially surrounded, in radially spaced apart relationship, by a sleeve 38. Each sleeve 38 extends between the bush 33 which locates the spigot 32 and a further bush 39 located on the duct wall 29. Apertures 40 permit the flow of cooling air into the annular space between each radially outer spigot 32 and its corresponding sleeve 38 as indicated by the arrows, to provide cooling of the spigots 32. The cooling air then flows past the bushes 31 locating the radially outer vane platforms 22 and, since it is at a pressure higher than that of the exhaust efflux operationally flowing through the power turbine 15, there is a nett flow of cooling air into that efflux.

Figure 3:
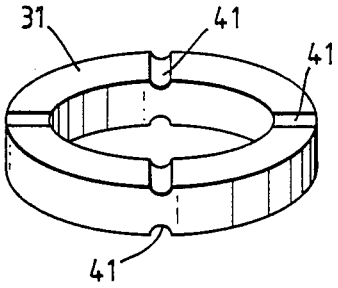
FIG. 3 is a view of a portion of the variable stator vane aerofoil vane assembly of FIG. 1.

It may be that in certain circumstances, the bushes are of a sufficiently loose fit between the radially outer vane platforms 22 and the wall 29 of the duct 16 to permit a flow of air past the bushes 31 which is sufficient to maintain them at an acceptably low temperature. However, if this is not the case, then each of the bushes 31, are of which can be seen more clearly in FIG. 3, may be provided with a series radially extending grooves 41 which permit an adequate flow of cooling air past the bushes 31.

Each radially outer spigot 32 and its corresponding vane 17 is provided with a common internal passage 42 which serves to interconnect the annular space between the spigot 32 and its surrounding sleeve 38 with the radially inner bush 24. Thus a portion of the cooling air which flows into the annular space between the spigot 32 and its surrounding sleeve 38 flows into the passage 42 and is directed thereby to the radially inner bush 24. As in the case of the radially outer bushes 31, the radially inner bushes 24 may be of a sufficiently loose fit between the radially inner vane platforms 21 and the support member 25 to permit an adequate flow of cooling air past the bushes 24 and into the gas flow through the power turbine 15. However if this is not the case, then grooves similar to those 41 in the bushes 31 may be provided in the bushes 24.

It will be seen therefore that during engine and power turbine operation, the bushes 24 and 31 are supplied with cooling air so that they are maintained at an acceptably low temperature and thereby permit the pivotal variation, as necessary, of the stator vanes 17. Moreover since the cooling air is at a higher pressure than the exhaust efflux which in operation passes through the power turbine 15, there is no leakage of hot exhaust efflux out of the main gas passage through the power turbine 15 to cause possible damage to other portions of the actuation mechanism for the variable vanes 17.

Figure 4:
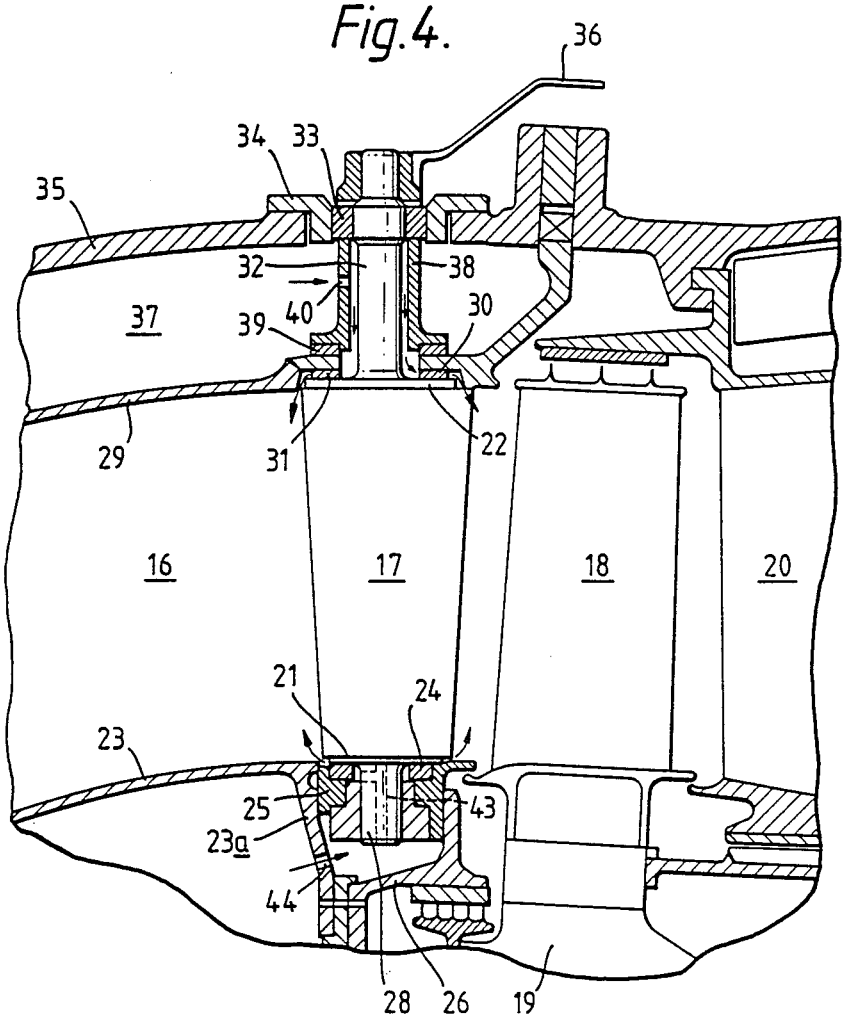
FIG. 4 is a view similar to that of FIG. 2 and showing an alternative embodiment of the present invention.

It may be found in certain circumstances that an insufficient quantity of cooling air can be passed down the passage 42 within the spigot 32 and vane 17 to provide adequate cooling of the radially inner bushes 24. In such cases, the embodiment of the present invention depicted in FIG. 4 may be utilized. In FIG. 4, like numerals are used to depict items which are common with those shown in FIG. 2.

The major difference between the embodiments of FIGS. 2 and 4 is that in the FIG. 4 embodiment, the vanes 17 and radially outer spigots 32 are not provided with internal passages 42 for the supply of cooling air to the radially inner bushes 24. Instead, each of the radially inner spigots 28 is provided with an internal passage 43 which is fed with cooling air directed through apertures 44 in the flange **23*a* and directs that cooling air to the radially inner bushes 24. As in the case of the FIG. 2 embodiment, the cooling air directed to the radially inner spigots 28 is derived from the gas turbine engine 11**.

I claim:

1. A variable stator aerofoil vane assembly comprising an annular array of generally radially extending aerofoil cross-section stator vanes, and support structure supporting the radially inner and outer extents of said vanes so that said vanes are pivotable about their longitudinal axes, each of said vanes being provided at each of its longitudinal extents with platform means to cooperate with said support structure to limit any radial movement of said vane, and bush means interposed between each of platform means and said support structure, means being provided to supply a cooling fluid to said bush means at pressure higher than that of any fluid operationally flowing over said vanes so that said cooling fluid flows between each of said bush means and at least one platform means and said support structure so the said cooling fluid is placed in heat exchange relationship with said bush means and is subsequently exhausted into said fluid operationally flowing over said vanes, each of said bush means adjacent a radially inner or outer platform being grooved to at least partially define passages for said cooling fluid.

2. A variable stator vane assembly as claimed in claim 1 wherein said cooling fluid is supplied to the region of the radially outer extent of each of said vanes, said cooling fluid so supplied being divided into two flow portions, a first flow portion which is directed to said bush means adjacent said radially outer platform, and a second flow portion which is directed via a longitudinal passage in each of said vanes to said bush means adjacent said radially inner platform.

3. A variable stator vane assembly as claimed in claim 1 wherein two separate flows of said cooling fluid from separate sources are supplied respectively to the radially inner and outer extents of each of said stator vanes to be placed in said heat exchange relationship with said bush means adjacent said radially inner and outer platforms respectively.

4. A variable stator vane assembly as claimed in claim 1 wherein each of said vanes is provided with a spigot extending radially from each of its extents, said spigots locating in corresponding bush means provided in said support structure to facilitate said pivotal movement of said vanes.

5. A stator vane assembly as claimed in claim 4 wherein each of said radially outer spigots is surrounded in spaced apart relationship by a sleeve so that a space is defined between them, said sleeves being positioned in a flow of said cooling fluid and apertured to permit said cooling fluid to flow through said so defined space and thence to said radially outer bush means.

6. A stator vane assembly as claimed in claim 1 wherein each of said radially outer spigots is provided with a lever to facilitate said vane pivoting.

7. A stator vane assembly as claimed in claim 1 wherein said cooling fluid is air.

8. A stator vane assembly as claimed in claim 1 wherein said vanes are positioned in the inlet of a power turbine.

* * * * *